United States Patent [19]

Sengewald

[11] Patent Number: 4,781,474

[45] Date of Patent: Nov. 1, 1988

[54] POUCH WITH LOOP HANDLE ATTACHED BY OVAL SEAL

[76] Inventor: K. H. Sengewald, Postfach 1460, 4802 Halle in Westf. 1, Fed. Rep. of Germany

[21] Appl. No.: 24,899

[22] Filed: Mar. 11, 1987

Related U.S. Application Data

[63] Continuation of Ser. No. 540,606, Oct. 7, 1983, abandoned.

[30] Foreign Application Priority Data

Nov. 18, 1982 [DE] Fed. Rep. of Germany ..... 3321808
Nov. 20, 1982 [DE] Fed. Rep. of Germany ..... 3242510
Nov. 20, 1982 [DE] Fed. Rep. of Germany ..... 3242976

[51] Int. Cl.[4] ..... B65D 33/06

[52] U.S. Cl. ..... 383/29; 229/52 A; 229/52 AL; 383/8; 383/12; 383/24

[58] Field of Search ..... 383/12, 17, 18, 21, 383/25, 26, 27, 29, 30, 24, 5-10; 206/806, 554, 493; 229/52 A, 52 AL

[56] References Cited

U.S. PATENT DOCUMENTS

| | | | |
|---|---|---|---|
| 1,733,219 | 10/1929 | Durall | 383/21 |
| 3,044,233 | 7/1962 | Altman, Jr. | 206/554 X |
| 3,101,887 | 8/1963 | Kugler | 383/9 X |
| 3,126,146 | 3/1964 | Bonsor | 383/10 |
| 3,240,420 | 3/1966 | Membruno | 383/10 |
| 3,380,579 | 4/1968 | Pinto | 206/493 |
| 3,507,194 | 4/1970 | Schwarzkopf | 383/6 X |
| 3,567,110 | 3/1971 | Susuki et al. | 383/6 X |
| 3,967,775 | 7/1976 | Kramming | 206/806 X |
| 4,252,269 | 2/1987 | Peppratt | 383/21 X |
| 4,573,203 | 2/1986 | Peppiatt | 383/8 |

FOREIGN PATENT DOCUMENTS

| | | | |
|---|---|---|---|
| 2751195 | 5/1979 | Fed. Rep. of Germany | 206/806 |
| 3321341 | 12/1983 | Fed. Rep. of Germany . | |
| 2428585 | 2/1980 | France | 229/DIG. 6 |
| 878107 | 9/1961 | United Kingdom | 383/29 |

*Primary Examiner*—Stephen Marcus
*Assistant Examiner*—Bryon Gehman
*Attorney, Agent, or Firm*—Michael J. Striker

[57] ABSTRACT

A pouch has a pair of side walls which are connected at the longitudinal edges thereof, and bottom folds. A single handle is arranged at the bottom fold wherein one end of the handle is connected to one side wall and the other end is connected to the other side wall. The pouch and the handle consist of thermoplastic plastic foil and are connected to each other by a welding seam. At the filling opening, the pouch is provided with a suspension hole and a slot which extend from the outer rim in direction to the suspension hole in order to provide a bridge therebetween and to allow the pouch to be suspended from respective pins. Through tearing of the bridge between the suspension hole and the slot, a pouch can be removed from the stack of pouches.

6 Claims, 5 Drawing Sheets

FIG. 4
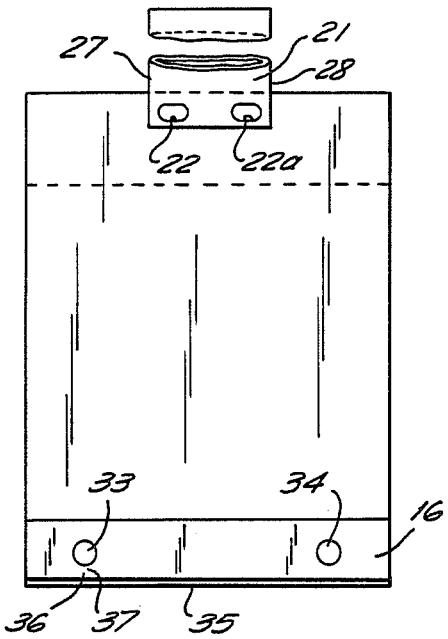
FIG. 5
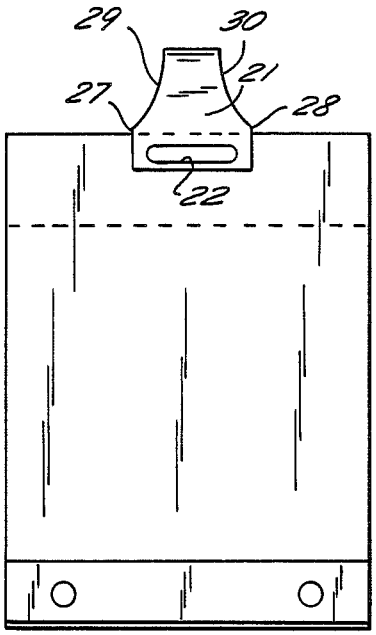
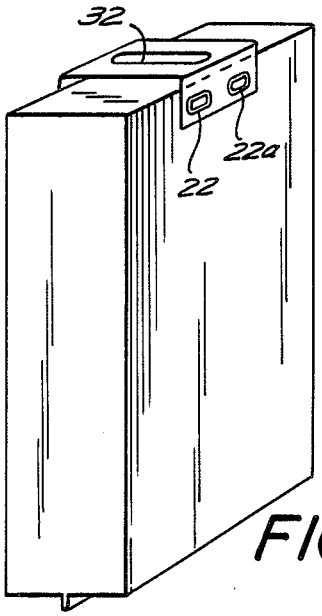
FIG. 6
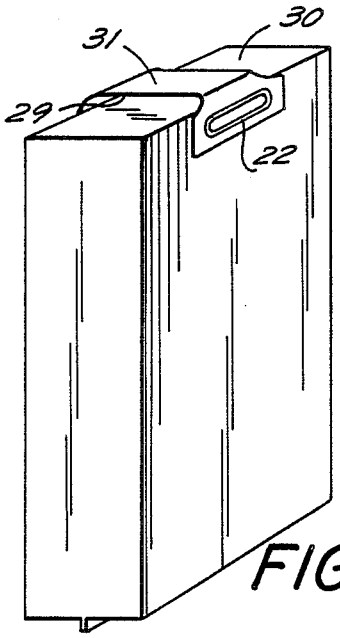
FIG. 7
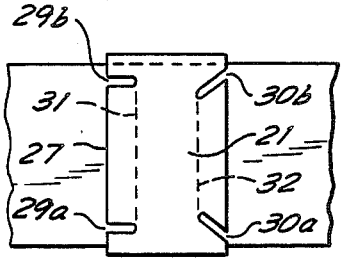
FIG. 8
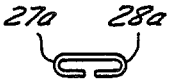
FIG. 10
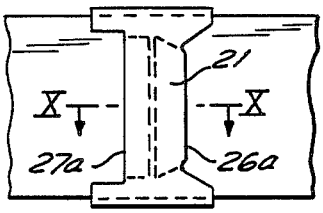
FIG. 9

POUCH WITH LOOP HANDLE ATTACHED BY OVAL SEAL

This application is a continuation of application Ser. No. 540,606, filed Oct. 7, 1983, now abandoned.

BACKGROUND OF THE INVENTION

The invention relates to a pouch, and particularly to a pouch which can be carried and torn off when being suspended. Moreover, the invention relates to an apparatus for and method of producing such a pouch.

Pouches, especially carrying pouches, have two side edges which are connected to each other and have bottom folds opposing the sealing opening. At the filling end, the pouches have handles. In case the handles are developed as loops, each side is provided with a loop extending in longitudinal direction of the pouch, that is both ends of a loop are fixed to a side wall.

Such pouches possess the difficulty that it is difficult to close the filling opening. Moreover, the gripping loops impair the filling process.

Pouches which can be torn off are also known. They are usually provided in vicinity of the edge defining the filling opening with two suspension holes. Since pouches have to be stacked after their production in order to be able to pack them as a stack, it has been proposed to fasten the pouches after their production on pins for providing a stacking. Consequently, pouch packings are provided. The pouches provided with suspension holes are also held by pins for their simplified delivery. These pins can be present in shops in order to allow a manual removal of one pouch from the pins in order to fill the purchased goods into the pouch. The mentioned pins are, however, also present in manufacturing plants for filling the pouches with the corresponding product, for example for packing bread or diapers. The removal of the pouches from the pins can be simply carried out by guiding upwardly the individual pouches along the pins so that the pouches are freed therefrom. In the same manner, the pins can be lowered when having pouches supported by a table. Both these measures are complicated and require an accurately working apparatus unless with regard to the first case the removal is carried out in a manual way.

It is also possible to draw off the pouches by increased exertion from the pin in a plane transverse to the longitudinal extension of the pin and to tear open the bridge between hole and edge of the pouch. As mentioned, an increased exertion is necessary, which can also be provided in a mechanical way.

In practice, it is however extremely difficult to align the holes in continuously same distance from the pouch edge, because the punching of the pouches is carried out in a processing station which is located prior to the provision of a transverse welding and the transverse cutting of the pouch. Since the distance between the hole and the filling edge is difficult to standardize, different forces are necessary in order to tear off the pouch from the pins in dependence on the distance of the punched holes to the edge. Unless a pouch is concerned having a flap, the pouch has punched holes in two foil layers, so that the forces exerted for tearing the pouch between the punched holes and the filling edge are doubled, respectively.

Simultaneously, in dependence on the width of the bridge between the punched holes and the edge, the differences have a doubled magnitude. Consequently, the separation of the pouches from the suspension pins is difficult in practice.

SUMMARY OF THE INVENTION

It is a general object of the present invention to avoid the prior art disadvantages.

In particular, it is an object of the present invention to provide a pouch which allows an easy filling and closing and which can be carried in an easy manner even at high volume.

Still another object of the present invention is to provide a pouch which allows a suspension thereof and can easily be torn off without necessitating an increased exertion of forces but can be drawn off indendent from the material thereof with constant exertion of force from the pins.

In keeping with these objects and with others which will become apparent hereinafter, one feature of the invention resides in a pouch which comprises a pair of side walls, each of which having longitudinal edges and a bottom fold the longitudinal edges of one of the side walls being connected to the associated longitudinal edges of the other sidewalls so as to define an interior, wherein each of the side walls has a top portion, the top portions after connecting the side walls to each other. defining a filling opening opposite to the bottom fold of each side wall, and a handle arranged at the bottom folds and having one end attached to the outside of one of the side walls and another end attached to the outside of the other of the side walls.

Through the provision of such a pouch, the filling and closing thereof can be performed without any hindrance through the handle because of its provision at the end opposing the filling opening. Since the single handle is merely fixed to the side walls, the bottom folds are effective in an optimum manner for filling of the pouch.

The pouch and the handle can be made of paper and the handle can be glued thereon. In a preferred embodiment, the pouch and the handle are made of thermoplastic plastic foil which then is connected to each other by welding.

Preferably, the ends of the handle are connected to the side walls of the pouch by a welding seam closed to a ring.

According to a further feature of the invention, the handle has a length corresponding to the depth of each bottom fold so that upon filling of the pouch, the bottom fold can be completely extended.

Preferably, the handle has a width of at least 6 cm in order to provide a high carrying capacity and to allow a comfortable carrying of the pouch. In a preferred embodiment of the pouch, the ends of the pouch connected to the respective side wall have a width of approximately 10 cm. It is certainly possible to provide a width of 10 cm also in the handle area, that is the center portion of the handle. Especially advantageous is to provide the end portions of the handle with a width which is larger than the width of the center portion which is contacted by the hand of the user. Through this feature, the carrying capacity is increased through the feature of the handle to the pouch and simultaneously the carrying is facilitated by the center portion of the handle which is reduced in width.

The reduction of the width of the center portion of the handle can be obtained in such a manner that recesses are provided in longitudinal direction of the handle, for example by providing an oblong hole in the center of this portion or by recesses extending at the longitudinal edges of the center portion.

According to a further feature of the invention, the center portion is provided with at least two slots spaced from each other between the end portions along one edge of the center portion, so as to obtain a fold edge which upon folding provides the recess. Advantageously, the slots are arranged at both longitudinal extending edges of the center portion of the handle so as to provide two fold edges which upon folding provide two recesses. The preferred embodiment is to provide two slots parallel to each other along one edge of the center portion and two further slots along the other edge of the center portion arranged at an acute angle to each other so as to provide a truncated cone-shaped recess.

The handle is produced of a foil tube which has sufficient strength in order to secure a good connection and a comfortable carrying by hand.

The filling volume of the pouch can be increased by providing the top portions in such a manner that upon closing of the interior of the pouch two projections are obtained which are connected to each other by welding, wherein one of the top portions is of such a length that the associated projection is of larger size than the other projection in order to form an over flap.

In order to provide the pouch in a manner that it can be separated or torn off from the unit of pouches, according to another feature, the pouch is provided with at least one suspension hole at the top portion and with a slot which extends from the outer edge in direction to the suspension hole so that a bridge is obtained there between.

Through this feature, there is obtained a weak point between the punched hole and the filling edge of the pouch so that upon application of a certain force the weakest point is overcome and the pouch can be taken off in a plane perpendicular to the longitudinal extension of the pin. The defined weakest point is a bridge of uniform predetermined size regardless of the distance between punched hole and outer edge of the pouch, because varying distances therebetween are compensated by the length of the slot. Consequently, the bridge is continuously of the same size, while on the other hand the slots can have different lengths. Through this provision the pouch can be torn off from the pins by constant force.

The side walls can be developed in such a manner that the top portion is provided of a plurality of superimposed folds, each fold being provided with a suspension hole, wherein at least one of the folds has a bridge between the slot and the suspension hole.

Through this provision, it is obtained that the force for drawing off a pouch from the pins is independent on whether suspension holes are provided in one or several foil layers because the bridge is only provided in one foil layer while the suspension holes of the other foil layers are either connected to the outer edge by a continuous slot or are arranged in such a manner that they extend to the filling edge by choosing a larger diameter. Therefore, the force exerted for tearing off the pouch is relatively small. The inventive features make it possible to provide suspension holes in pouches with side folds. In such pouches, eight holes are provided when four side folds are used, whereby only in one foil layer are the slots respectively separated from both punched holes by a respective bridge.

According to another feature of the invention, an apparatus for producing a pouch which can be torn off comprises punching means which includes a stamp having a first cutting edge for providing the suspension holes and a knife connected to the stamp and having a second cutting edge for providing the slots, wherein the cutting edge and the further cutting edge have a distance from each other so as to provide a bridge between the suspension hole and the slot to be formed. Through such an apparatus, the punching of the holes and the cutting of the slots is obtained in the same working step and provides that the bridge has a constant width. It is, however, also possible to change the width of the bridge in order to guarantee a uniform force for tearing off the pouch independent of the foil material.

The stamp for punching the suspension hole is connected with the knife, which is provided with a third cutting edge located at an elevated position with respect to the second cutting edge. These cutting edges of the knife cooperate with each other in such a manner that, except the one foil layer in which the slot and the suspension hole are separated by a bridge in the other foil layers, the respective slots extend to the associated suspension hole. Advantageously, the stamp is provided with a recess through which a fastening element projects in order to connect the knife thereto. As fastening element, for example a screw may be used. In order to provide bridges of different sizes, the knife is movable in radial direction with respect to the stamp, so as to allow to adjust the size of the bridges by simple tools.

In order to provide the different foil layers of the pouch with punched holes cooperating with a bridge and punch holes without cooperation with a bridge, it is proposed to locate a plate within the tube of which the pouch is produced wherein the plate is provided with through passages in the area of the suspension holes to be provided.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIGS. 4 and 5 are side views of the pouch with modified handles;

FIGS. 6 and 7 are a perspective illustration of the pouch with different handles;

FIG. 8 is a top view on the pouch illustrating partly the handle;

FIG. 9 is an illustration according to FIG. 8 wherein the respective portions of the handle are folded;

FIG. 10 is a cross-sectional view of the handle according to FIG. 9;

DESCRIPTION OF THE PREFERRED EMBODIMENTS

Figure 1:
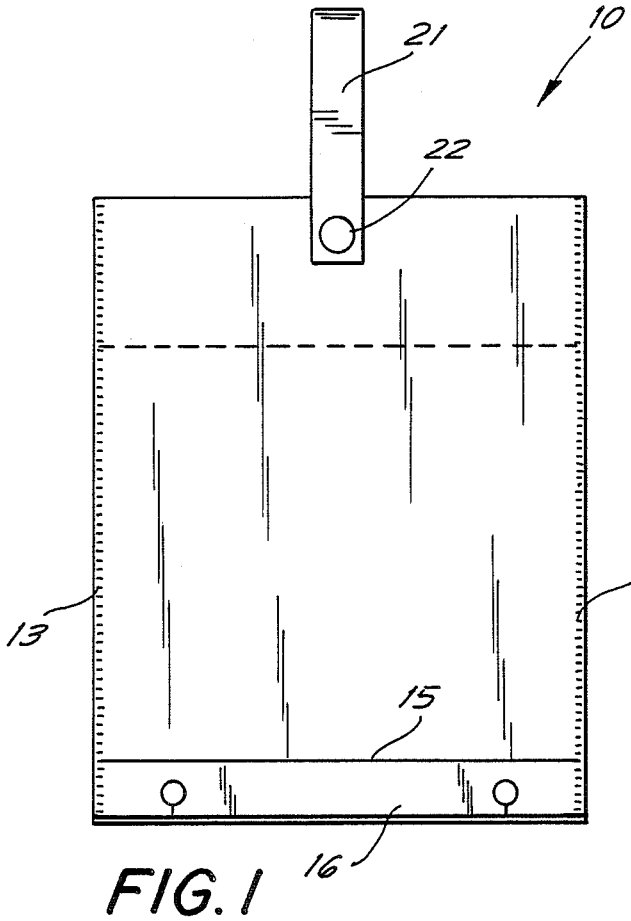
FIG. 1 is a side view of a pouch according to the invention.

Referring firstly to FIG. 1, there is shown a pouch 10 having two sides walls 11, 12 which are connected with each other along the longitudinal edges by respective welding seams 13, 14. At the filling side defined by the filling edge 15, the pouch has an overflap 16. As can be seen from FIG. 2, the pouch is provided with two bottom folds 17, 18 which are located opposite to the filling opening. In the area of the bottom folds, the ends 19, 20 of a handle 21 are connected to the associated side walls 11, 12.

In case the pouch 10 and the handle 21 are made of thermoplastic foil, the ends 19, 20 of the handle 21 are connected to the associated side walls 11, 12 preferably by an annular welding seam 22. In order to provide the welding of the ends 19, 20 with the associated side walls 11, 12, the production and fastening of the handle is obtained in such a manner that a plate or a web, for example of Teflon, is arranged between the wall 11 and the bottom fold 17 on the one hand and the wall 12 and the bottom fold 18 on the other hand, so that upon providing the welding seam 22, the formation of a bridge between the bottom fold 17, 18 is prevented.

Figure 3:
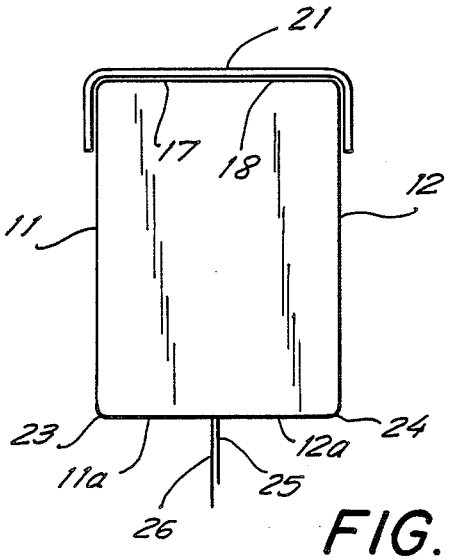
FIG. 3 is a view according to FIG. 2 showing the pouch being filled with a product.

In FIG. 3, the pouch 10 is shown as being filled by the respective product and it may be seen that the bottom folds 17, 18 are extended so as to form a flat bottom. Also, the handle 21 is arranged in a flat manner in the area of the bottom folds 17, 18, but it is still so loose as to allow easy manual gripping and easy lifting from the bottom because the side walls 11 and 12 yield. This depends in addition also on the used filling product. In case for example diapers are concerned, the development of the pouch of foil provides a soft packing which promotes the easy gripping of the handle 21. In order to provide the handle 21 to lie against the bottom when the pouch is filled, the length of the handle measured from the connection of one end to the other end corresponds to the depth of both bottom folds 17, 18.

As shown in FIG. 3, illustrating the closed pouch, the side walls 11, 12 are bent towards each other in the area **11*a* and 12*a* and consequently form the edges 23, 24. The wall portions 11*a*, 12*a* so bent are connected with each other by a transverse welding seam 25. In addition, a separating section 26 is provided for separating the overflap 16**.

The handle 21 has preferably a width of at least 6 cm and the ends 19, 20 are welded to the associated side walls 11, 12 by respective weldings **22, 22*a* which are closed to a ring. As can be especially seen from FIG. 4, the welding seams 22, 22*a*** are oval-shaped.

The handle 21 consists of a tube of thermoplastic plastic foil and thus is double-walled having rounded lateral edges 27, 28.

The handle 21 as shown in FIG. 5 is attached to the associated side walls 11, 12 in such a manner that the end portions thereof have a width of 10 cm and are welded to the associated side wall of the pouch by a single welding seam 22 which is of elongated oval shape. As can be seen in FIGS. 5 and 7, the center portion 31 which is gripped by the hand of the user is of smaller width than the end portion of the handle 21, so that recesses 29, 30 are obtained which extend from the side edges 27, 28 of the respective end portions. The handle 21 is attached to the associated side walls by the welding seam 22. FIG. 7 shows the pouch in the filled state.

In FIG. 6, a modification of the handle 21 is shown, wherein the center portion 31 is provided with a centrically arranged oblong hole 32 so as to actually provide the reduction of the width thereof. The end portions are connected to the associated side walls by respective oval-shaped welding seams **22, 22*a***.

In a further modification of the handle 21, the center portion 31 is provided with notches **29*a*, 29*b* spaced from each other in longitudinal direction of the center portions at the side edge 27 and with notches 30*a*, 30*b* at the other side edge 28. The notches define the lateral limitation for the recesses 29, 30 to be formed which are obtained by folding the side edges 27, 28 about the folding lines 31, 32. Preferably, the side edges 27, 28 are inwardly folded. This is shown in FIGS. 9 and 10. Consequently, the center portion 31 of the handle 21 is tube-like in shape and has rounded edges 27*a*, 28*a*** in the gripping area.

As can be further seen from the Figures, the flap 16 is provided with holes 33, 34 at a distance to the filling rim 35. The distance of the holes 33, 34 to the rim 35 determines the force necessary to tear off the pouch from pins 72, 73. Located between the suspension holes 33, 34 and the rim 14 is a slot **36, 36*a* so as to form a respective bridge 37, 37*a***.

Figure 11:
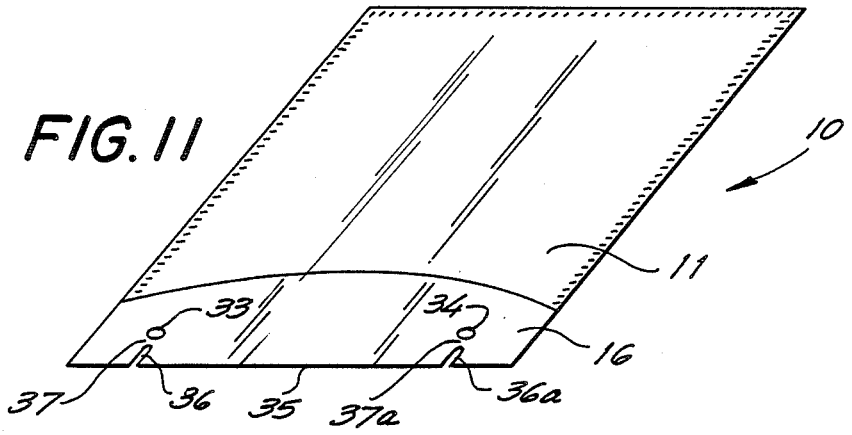
FIG. 11 is a separable pouch.

It is to be noted that certainly only one suspension hole may be provided instead of two suspension holes as shown for example in FIGS. 1 and 11.

The bridge **37, 37*a*** has a constant width in order to guarantee a constant force to tear off the pouch by ripping the bridge.

In case the pouch consists of several foil layers, only one of the foil layers, in the present case the side wall or foil layer 12, is provided with a bridge 37 while in the foil layer 11 as well as in the side fold **17*a*, 18*a* of one side and 20, 21 of the other side suspension holes 33, 34 are provided with slots 36, 36*a* extending from the outer rim 7 to the respective suspension holes 33, 34 and thus no bridge 36 or 36*a*** is provided.

Figure 13:
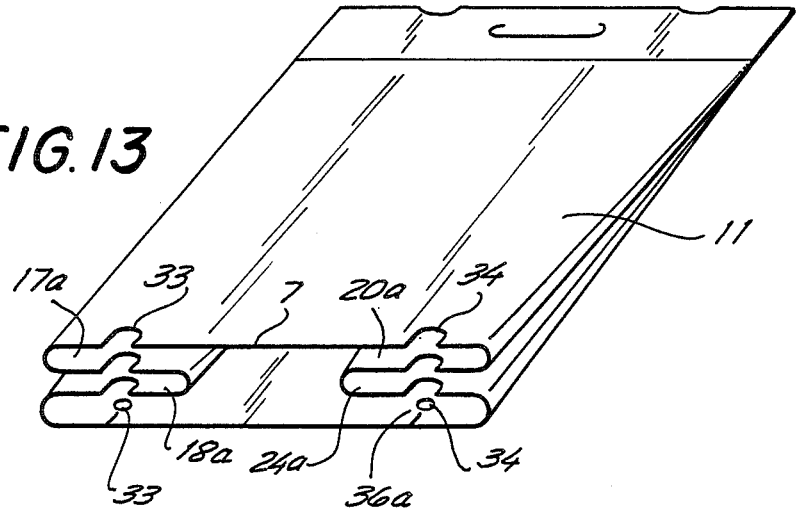
FIG. 13 is a modified pouch with side folds.

As shown in FIG. 13, it is however also possible to provide the suspension holes 33, 34 of enlarged diameter so that they extend towards the filling rim 7 or in the side folds to the outer edges, respectively, wherein again the side wall 12 is provided with a bridge between the respective slots and the suspension holes.

Figure 14:
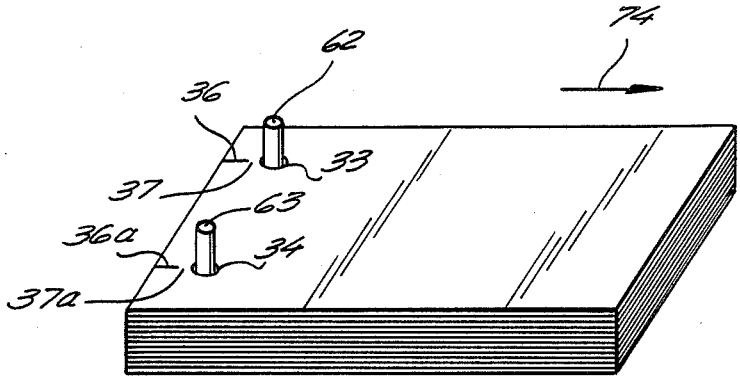
FIG. 14 is a perspective illustration of a pouch held by pins.
Figure 15:
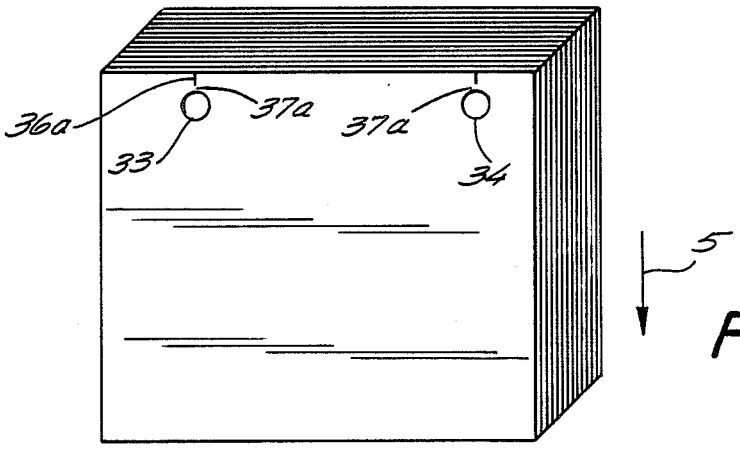
FIG. 15 is a perspective illustration of a pouch suspending from pins.

As can be seen from FIGS. 14 and 15, several pouches 10 are arranged in a set on the pins 72, 73 which protrude through the suspension holes 33, 34. The slots **36, 36*a* do not extend through the associated suspension holes, so that the bridges 37, 37*a* are respectively obtained. The pouches are drawn off in direction of arrow 74 as in FIG. 14, or in direction of arrow 75 as in FIG. 15, in order to tear open the bridges 37, 37***a*. The bridges 37, 37*a* can be provided in both foil layers of a pouch; in case, however, more than two foil layers are provided, it is preferred to provide the bridges 37, 37*a* only in one or two foil layers.

Figure 16:
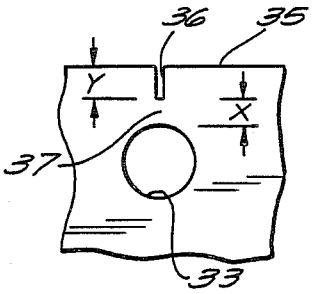
FIG. 16 is a sectional view of the pouch showing a suspension hole with small distance to the outer edge.
Figure 17:
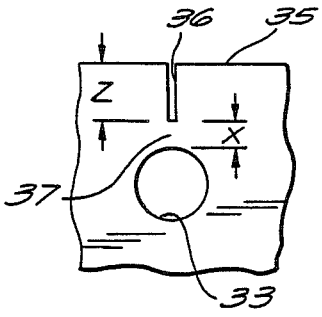
FIG. 17 is a sectional view of a pouch showing a suspension hole having a larger distance to the outer edge.
Figure 18:
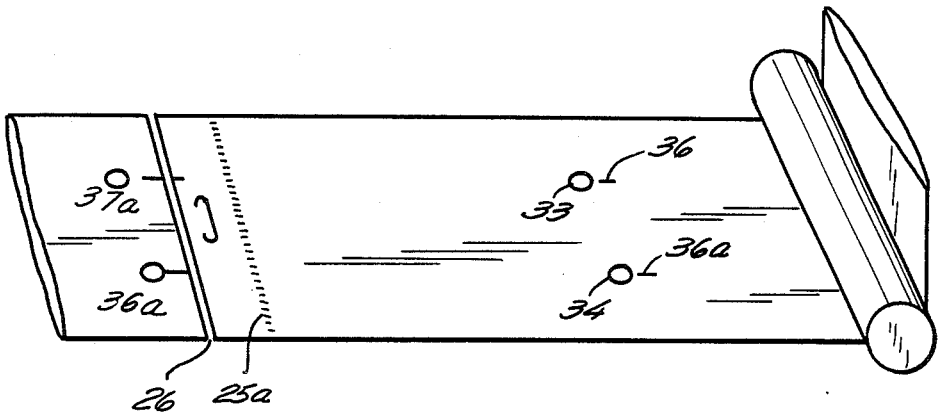
FIG. 18 is a perspective and essentially schematic illustration of the production of suspension holes in the pouch.

As already mentioned, the length of each slot may be modified in order to provide bridges of uniform length. In FIG. 16, the slot 36 has a length Y while in FIG. 17 a length of Z is provided in order to guarantee a corresponding length of X of the respective bridges 37. Consequently, the suspension holes 33 can have different distances to the rim 14 of the filling opening so that through the length of the slot 36, bridges 37 of equal dimensions are obtained.

The pouches are produced by guiding a tube along a predetermined path. A respective tool provides the suspension holes 33, 34 adjacent to each other along a line transverse to the forward movement of the tube and the slots 36, 36*a*. In a subsequent working step, the welding seam 25 and the separating cut 26 are provided. It is possible to provide the separating cut 26 at a distance to the welding seam 25. It is, however, essential that the separating cut 27 crosses the slot 36, 36*a* in order to provide the slots to the outer rim. The bridges 37, 37*a* are not influenced and remain of constant width.

Figure 19:
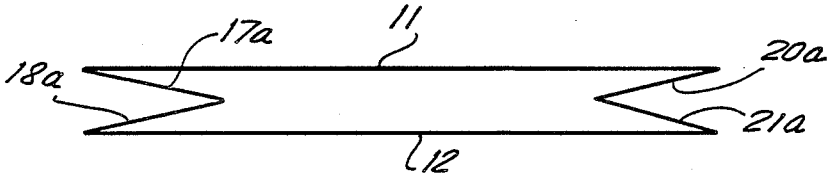
FIG. 19 is a sectional view through the pouch having side folds.
Figure 20:
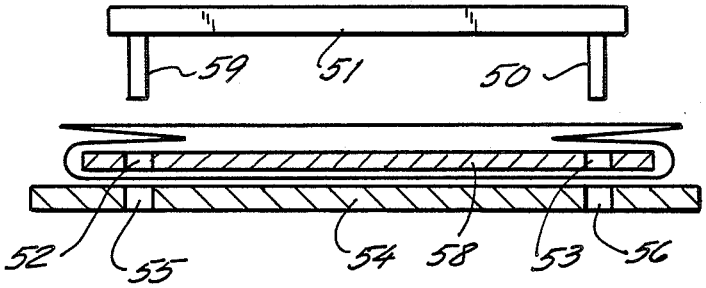
FIG. 20 is a schematic illustration of an apparatus for punching the pouch according to FIG. 19.
Figure 21:
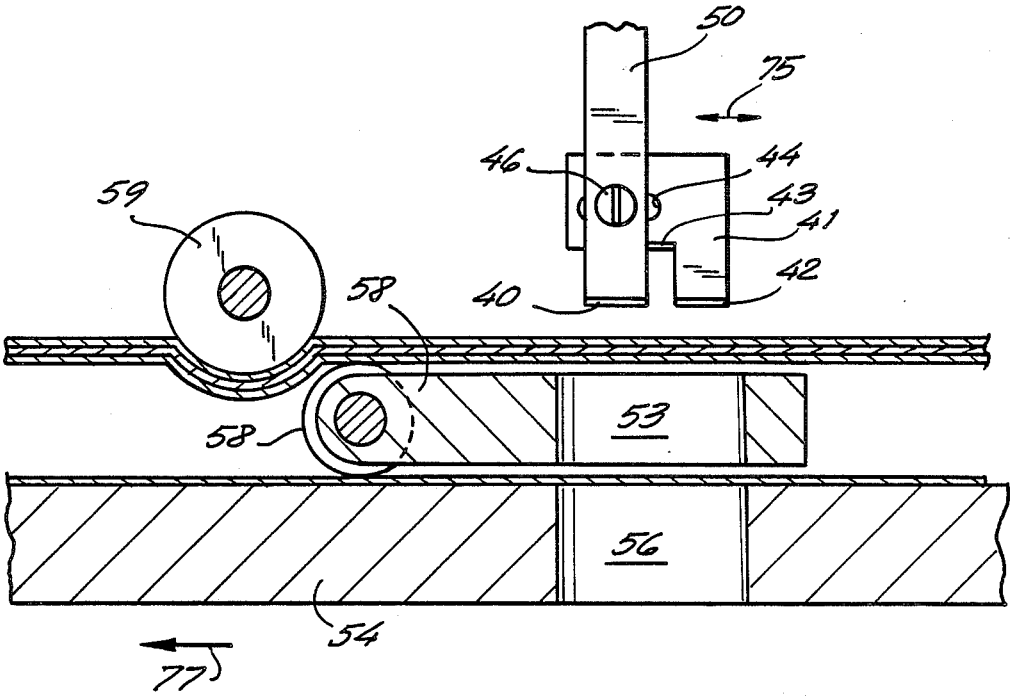
FIG. 21 is a longitudinal sectional view of an apparatus for punching the pouch having side folds in an enlarged illustration.

In FIG. 19, a tube is shown with a side fold 17*a*, 18*a* as well as 20*a* in a sectional view.

In order to provide the respective suspension holes in the tube, a plate 58 is located between the side folds 18*a*, 21*a* as well as in the foil layer 12, which plate 58 has through passages 52, 53. When providing the suspension holes in the tube, the through passages 52, 53 are in alignment with projecting rod 59, 60 of a stamp which rods are connected with each other by a cross bar. The support 54 is provided for supporting the tube, and cooperated with the plate 58 which is also provided with associated through passages 65, 66 so that in the upper foil layer 11 and in the side walls 17*a*, 18*a*, 20*a*, 21*a*, suspension holes of different diameter or slots 36, 36*a* of different lengths can be provided than in the lower foil layer 12.

When the tube is moved in the direction of arrow 77, the plate 58 located within the tube and provided at its foremost edge with two rolls 58 rests against the roll 59 under interposition of the foil 11 as well as the side folds. The rolls 58, 59 are provided with respective axes. Therefore, the plate 58 is stationarily kept.

Figure 2:
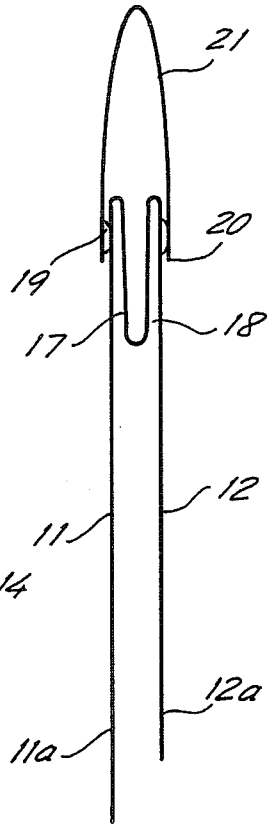
FIG. 2 is a vertical cross-sectional view of the pouch.
Figure 12:
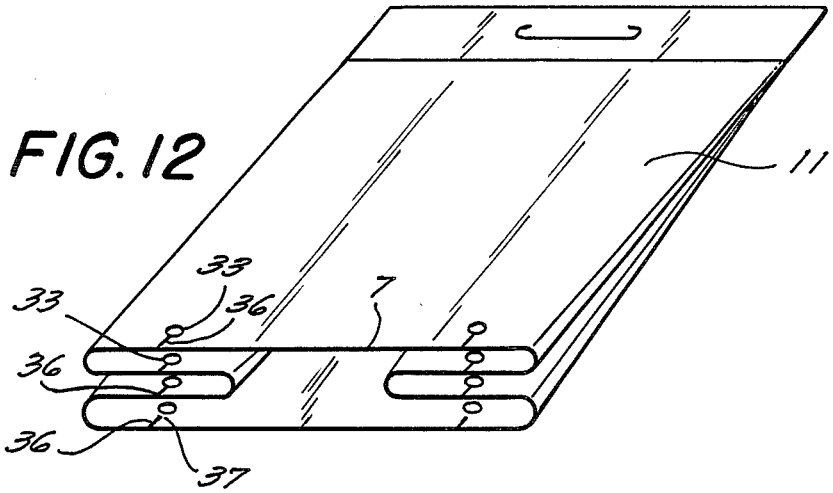
FIG. 12 is a pouch provided with side folds.

In order to provide a suspension hole and a slot according to FIG. 12, a stamp 60 is provided having a forward running cutting edge 40. Connected to the stamp 30 is a knife 41 which is provided with a lower cutting edge 42 and an upper cutting edge 43. The cutting edge 40 which is of annular shape provides the suspension hole 33 which according to FIG. 2 is of constant diameter in all foil layers. The cutting edge 42 of the knife 41 is of short length. Since there is a distance to the periphery of the cutting edge 40, a gap is obtained which corresponds to the bridge 36 provided in the lower foil layer 12. In order to provide a continuous slot from the outer rim to the respective suspension hole in the upper foil layers 11, 20*a*, 21, the cutting edge 42 cooperates with the cutting edge 43, which is in an elevated position with respect to the cutting edge 42. Consequently, only in the lower foil layer is the bridge obtained while in the upper foil layer a continuous slot is provided.

In order to adjust the width X of the bridge 36 independent on the foil thickness and the foil material, the knife 41 is provided with an oblong hole 44. The stamp 50 has also a continuous slot so that the knife is movable in direction of double arrow 75. The position of the knife 41 to the stamp 50 is provided for example by a screw 46.

In case it is desired to provide suspension holes 33, 34 with different diameters as shown in FIG. 13, the stamp 30 is step-shaped so as to have a lower area of smaller diameter in order to provide the lower foil layer 12 with a suspension hole of smaller size and an upper area of larger diameter in order to provide the respective suspension holes in the other foil layers 11, 17*a*, 19*a*, 20*a*, 21.

It will be understood that each of the elements described above, or two or more together, may also find a useful application in other types of pouches, methods and apparatuses for producing a pouch, different from the types described above.

While the invention has been illustrated and described as embodied in a pouch, and in an apparatus for and method of producing a pouch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A pouch made of thermoplastic foil and comprising a pair of side walls each having longitudinal edges, bottom portion, and a top portion, the longitudinal edges of one of the side walls being connected to the associated longitudinal edges of the other of the side walls so as to define an interior, the bottom portions having bottom folds, the top portions after connecting the side walls to each other defining a filling opening opposite to the bottom fold of each side wall; and only one one-piece handle of one strip thermoplastic foil and having a width which is considerably smaller than a width of the side walls, said one-piece one strip handle being arranged in the region of the bottom folds and only in a central region spaced from the longitudinal edges and extending substantially parallel to the latter, said one-piece one strip handle having one end attached to the outside and only with the one of the side walls and another end attached to the outside and only with the other of the side walls so that a bridge between the one sidewall and the association bottom fold and between the other side wall and the associated bottom fold is prevented, the one and the other end of said one-piece one strip handle being welded to the associated side wall by a single welding seam which is of elongated oval shape and has an axis of elongation extending transversely of the longitudinal edges.

2. A pouch as defined in claim 1, wherein the handle has a width of 10 cm.

3. A pouch as defined in claim 1, wherein the handle is developed as a foil tube.

4. A pouch as defined in claim 1, wherein the handle has a center portion connecting the one and the other end of the handle, wherein the one and the other end of the handle have a width, the center portion having a width smaller than the width of the one and the other end portion.

5. A pouch as defined in claim 1, wherein the handle has a length and each bottom fold of each side wall has a depth, the length of the handle corresponding to the depth of the both bottom folds.

6. A pouch made of thermoplastic foil and comprising a pair of side walls each having longitudinal edges, bottom portion, and top portion, the longitudinal edges of one of the side walls being connected to the associated longitudinal edges of the other of the side walls so as to define an interior, the bottom portions having bottom folds, the top portions after connecting the side walls to each other defining a filling opening opposite to the bottom fold of each side wall; and only one one-piece handle of one strip thermoplastic foil and having a width which is considerably smaller than a width of the side walls and which is equal over its whole length, said one-piece one strip handle being arranged in the region of the bottom folds and only in a central region spaced from the longitudinal edges and extending substantially parallel to the latter, said one-piece one strip handle having one end attached to the outside and only with the one of the side walls and another end attached to the outside and only with the other of the side walls so that a bridge between the one side wall and the association bottom fold and between the other side wall and the associated bottom fold is prevented, the one and the other end of said one-piece one strip handle being welded to the associated side wall by a single welding seam which is of elongated oval shape and has an axis of elongation extending transversely of the longitudinal edges.

* * * * *